US011313200B2

(12) United States Patent
Zakharia

(10) Patent No.: US 11,313,200 B2
(45) Date of Patent: Apr. 26, 2022

(54) ANTI-EXTRUSION SLIP ASSEMBLIES FOR A DOWNHOLE SEALING DEVICE

(71) Applicant: G&H Diversified Manufacturing LP, Houston, TX (US)

(72) Inventor: Steven M. Zakharia, Houston, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 4 days.

(21) Appl. No.: 16/945,377

(22) Filed: Jul. 31, 2020

(65) Prior Publication Data

US 2021/0032955 A1 Feb. 4, 2021

Related U.S. Application Data

(60) Provisional application No. 62/882,260, filed on Aug. 2, 2019.

(51) Int. Cl.

| | |
|---|---|
| ***E21B 33/12*** | (2006.01) |
| ***E21B 33/127*** | (2006.01) |
| ***E21B 33/128*** | (2006.01) |
| ***E21B 33/129*** | (2006.01) |
| ***E21B 33/134*** | (2006.01) |

(52) U.S. Cl.

CPC ..... *E21B 33/1216* (2013.01); *E21B 33/127* (2013.01); *E21B 33/128* (2013.01); *E21B 33/129* (2013.01); *E21B 33/134* (2013.01)

(58) Field of Classification Search

CPC .. E21B 33/1216; E21B 33/127; E21B 33/128; E21B 33/129; E21B 33/134; E21B 23/06; E21B 33/1291

See application file for complete search history.

(56) References Cited

U.S. PATENT DOCUMENTS

| | | | | |
|---|---|---|---|---|
| 3,497,002 | A * | 2/1970 | Berryman | E21B 33/129 166/123 |
| 3,506,067 | A * | 4/1970 | Lebourg | E21B 33/1204 166/134 |
| 3,530,934 | A * | 9/1970 | Kisling | E21B 33/129 166/134 |
| 9,273,526 | B2 * | 3/2016 | Oberg | E21B 33/129 |
| 10,119,360 | B2 | 11/2018 | Kellner et al. | |
| 10,408,011 | B2 | 9/2019 | Harris | |
| 2003/0226660 | A1 * | 12/2003 | Winslow | E21B 33/1293 166/118 |

(Continued)

*Primary Examiner* — Daniel P Stephenson

(74) *Attorney, Agent, or Firm* — Conley Rose, P.C.

(57) ABSTRACT

A downhole plug for plugging a tubular member. The downhole plug may include a packer and a slip assembly including a plurality of slip segments circumferentially spaced about a central axis of the slip assembly, each slip segment having a body comprising a first end, a second end longitudinally opposite the first end, an outward face with at least one engagement member for coupling to the tubular member, and sides each facing an adjacent slip segment of the plurality of slip segments. The plurality of slip segments may include a first set of slip segments and a second set of slip segments wherein each of the first set of slip segments is positioned directly between a pair of the second set of slip segments. Each of the second set of slip segments may include a pair of arcuately extending anti-extrusion members.

16 Claims, 14 Drawing Sheets

(56) References Cited

U.S. PATENT DOCUMENTS

| | | | | |
|---|---|---|---|---|
| 2009/0308592 | A1* | 12/2009 | Mercer | E21B 33/128 166/134 |
| 2011/0036561 | A1* | 2/2011 | Bishop | E21B 33/128 166/134 |
| 2012/0097384 | A1* | 4/2012 | Valencia | E21B 33/1204 166/134 |
| 2013/0269929 | A1* | 10/2013 | Smith | E21B 33/1216 166/118 |
| 2014/0262214 | A1* | 9/2014 | Mhaskar | E21B 33/1291 166/216 |
| 2015/0027737 | A1* | 1/2015 | Rochen | E21B 23/01 166/382 |
| 2016/0376869 | A1* | 12/2016 | Rochen | E21B 23/06 166/135 |
| 2018/0328132 | A1* | 11/2018 | Walton | E21B 33/128 |
| 2019/0112891 | A1 | 4/2019 | Kellner | |
| 2019/0120011 | A1 | 4/2019 | Kellner | |
| 2019/0218873 | A1* | 7/2019 | Davis | E21B 33/1293 |
| 2020/0392808 | A1* | 12/2020 | Greenlee | E21B 33/129 |
| 2021/0032955 | A1* | 2/2021 | Zakharia | E21B 33/1291 |
| 2021/0270099 | A1* | 9/2021 | Mhaskar | E21B 23/01 |

* cited by examiner

ANTI-EXTRUSION SLIP ASSEMBLIES FOR A DOWNHOLE SEALING DEVICE

CROSS-REFERENCE TO RELATED APPLICATIONS

This application claims benefit of U.S. provisional patent application Ser. No. 62/882,260 filed Aug. 2, 2019, and entitled "Anti-Extrusion Slip Assembly for a Downhole Sealing Device," which is hereby incorporated herein by reference in its entirety.

STATEMENT REGARDING FEDERALLY SPONSORED RESEARCH OR DEVELOPMENT

Not applicable.

BACKGROUND

After a wellbore has been drilled through a subterranean formation, the wellbore may be cased by inserting lengths of pipe ("casing sections") connected end-to-end into the wellbore. Threaded exterior connectors known as casing collars may be used to connect adjacent ends of the casing sections at casing joints, providing a casing string including casing sections and connecting casing collars that extends from the surface towards the bottom of the wellbore. The casing string may then be cemented into place to secure the casing string within the wellbore.

In some applications, following the casing of the wellbore, a wireline tool string may be run into the wellbore as part of a "plug-n-perf" hydraulic fracturing operation. The wireline tool string may include a perforating gun for perforating the casing string at a desired location in the wellbore, a downhole sealing device or plug settable to isolate a portion or section of the wellbore, and a setting tool for setting the downhole plug. To accomplish this isolation, the downhole plug sealingly engages with an inner surface of the casing string to thereby create a fluid tight boundary therebetween. In some applications, the downhole plug includes one or more slips that are actuated to engage with the inner surface of the casing string to thereby affix the downhole plug to the casing string and thereby withstand a differential pressure that is applied across the installed downhole plug during production or other operations that occur thereafter.

SUMMARY OF THE DISCLOSURE

An embodiment of a slip assembly for a downhole plug comprises a plurality of first slip segments circumferentially spaced about a central axis of the slip assembly, each first slip segment comprising a first body and a first engagement member for coupling to a tubular member; and a plurality of second slip segments circumferentially spaced about the central axis, each second slip segment comprising a second body, a second engagement member for coupling to the tubular member, and an arcuately extending anti-extrusion member, wherein the anti-extrusion member is at least one of monolithically formed with the second body and coupled to the second body whereby relative movement between the second body and the anti-extrusion member is restricted; wherein each of the plurality of first slip segments and the plurality of second slip segments comprise a radially inner position and a radially outer position, and wherein the anti-extrusion member of each second slip segment arcuately overlaps one of the plurality of first slip segments when the plurality of first slip segments and the plurality of second slip segments are in the radially outer position. In some embodiments, the anti-extrusion member is monolithically formed with the second body. In some embodiments, the second body has a first end, a second end opposite the first end, a pair of lateral sides extending between the first end and the second end, and wherein the anti-extrusion member extends laterally from the first end of the second body; and the anti-extrusion member comprises a first anti-extrusion member and each of the plurality of second slip segments comprises a second anti-extrusion member extending from the first end of the second body in a lateral direction opposite the first-extrusion member. In certain embodiments, the first body has a first end, a second end opposite the first end, and a first axial length extending from the first end to the second end; and the second body has a first end, a second end opposite the first end, and a second axial length extending from the first end to the second end that is greater than the first axial length. In certain embodiments, the first body has a first end, a second end opposite the first end, a pair of lateral sides extending between the first end and the second end, and a first width extending between the pair of lateral of lateral sides; and each of the plurality of second slip segments comprises a first anti-extrusion member and a second anti-extrusion member, and wherein a second width extending between a terminal end of the first anti-extrusion member and a terminal end of the second anti-extrusion member is greater than the first width. In some embodiments, the anti-extrusion member comprises an engagement surface that slidably engages a first end of the first body. In some embodiments, the anti-extrusion member of each second slip segment extends entirely across an arcuate gap formed between the second slip segment and one of the first slip segments the plurality of first slip segments and the plurality of second slip segments are in the radially outer position.

An embodiment of a downhole plug for sealing a wellbore comprises a packer configured to seal the wellbore in response to the plug being actuated from a first configuration to a second configuration; and a slip assembly configured to couple to a tubular member disposed in the wellbore in response to the plug being actuated from the first configuration to the second configuration, the slip assembly comprising a plurality of first slip segments circumferentially spaced about a central axis of the slip assembly, each first slip segment comprising a first body and a first engagement member for coupling to a tubular member; and a plurality of second slip segments circumferentially spaced about the central axis, each second slip segment comprising a second body, a second engagement member for coupling to the tubular member, and an arcuately extending anti-extrusion member, wherein the anti-extrusion member is at least one of monolithically formed with the second body and coupled to the second body whereby relative movement between the second body and the anti-extrusion member is restricted; wherein each of the plurality of first slip segments and the plurality of second slip segments comprise a radially inner position and a radially outer position, and wherein the anti-extrusion member of each second slip segment arcuately overlaps one of the plurality of first slip segments when the plurality of first slip segments and the plurality of second slip segments are in the radially outer position. In some embodiments, the downhole plug further comprises a mandrel configured to couple to a setting tool for actuating the plug from the first configuration to the second configuration, wherein the packer and the slip assembly are each positioned about the mandrel. In some embodiments, the anti-extrusion member is monolithically formed with the second body. In some embodiments, the second body has a first end, a second end opposite the first end, a pair of lateral sides extending between the first end and the second end, and wherein the anti-extrusion member extends laterally from the first end of the second body. In certain embodiments, the first body has a first end, a second end opposite the first end, a pair of lateral sides extending between the first end and the second end, and a first width extending between the pair of lateral of lateral sides; and each of the plurality of second slip segments comprises a first anti-extrusion member and a second anti-extrusion member, and wherein a second width extending between a terminal end of the first anti-extrusion member and a terminal end of the second anti-extrusion member is greater than the first width. In certain embodiments, wherein a terminal end of the anti-extrusion member of one of the plurality of second slip segments contacts a terminal end of the anti-extrusion member of another of the plurality of second slip segments when the plug is in the first configuration. In some embodiments, the anti-extrusion member extends entirely across an arcuate gap formed between one of the first slip segments and one of the second slip segments when the plug is in the second configuration. In some embodiments, the anti-extrusion member of each second slip segment arcuately overlaps one of the plurality of first slip segments when the plurality of first slip segments and the plurality of second slip segments are in the radially inner position. In certain embodiments, the anti-extrusion member extends entirely across a gap formed between one of the first slip segments and one of the second slip segments when the plug is in the second configuration.

An embodiment of a downhole plug for sealing a wellbore comprises a packer configured to seal the wellbore in response to the plug being actuated from a first position to a second position; and a slip assembly configured to couple to a tubular member disposed in the wellbore in response to the plug being actuated from the first position to the second position, the slip assembly comprising a plurality of first slip segments circumferentially spaced about a central axis, each first slip segment comprising a first body and a first engagement member for coupling to a tubular member; and a plurality of second slip segments circumferentially spaced about the central axis, each second slip segment comprising a second body having a first end and a second end opposite the first end, and a second engagement member for coupling to the tubular member; wherein each second slip segment comprises an anti-extrusion member comprising a pair of arms positioned at the first end of the second body and extending arcuately in opposing directions, and wherein the anti-extrusion member is at least one of monolithically formed with the second body and coupled to the second body whereby relative movement between the second body and the anti-extrusion member is restricted; wherein each arm of the anti-extrusion of each second slip segment extends entirely across a gap formed between one of the first slip segments and the second slip segment when the plug is in the second configuration. In some embodiments, the anti-extrusion member is monolithically formed with the second body. In some embodiments, the downhole plug further comprises a mandrel configured to couple to a setting tool for actuating the plug from the first configuration to the second configuration, wherein the packer and the slip assembly are each positioned about the mandrel. In certain embodiments, each of the pair of arms of each second slip segment comprises a shoulder which slidingly engages an end of the first body of one of the plurality of first slip segments.

BRIEF DESCRIPTION OF THE DRAWINGS

For a detailed description of exemplary embodiments of the disclosure, reference will now be made to the accompanying drawings in which.

DETAILED DESCRIPTION

Figure 1:
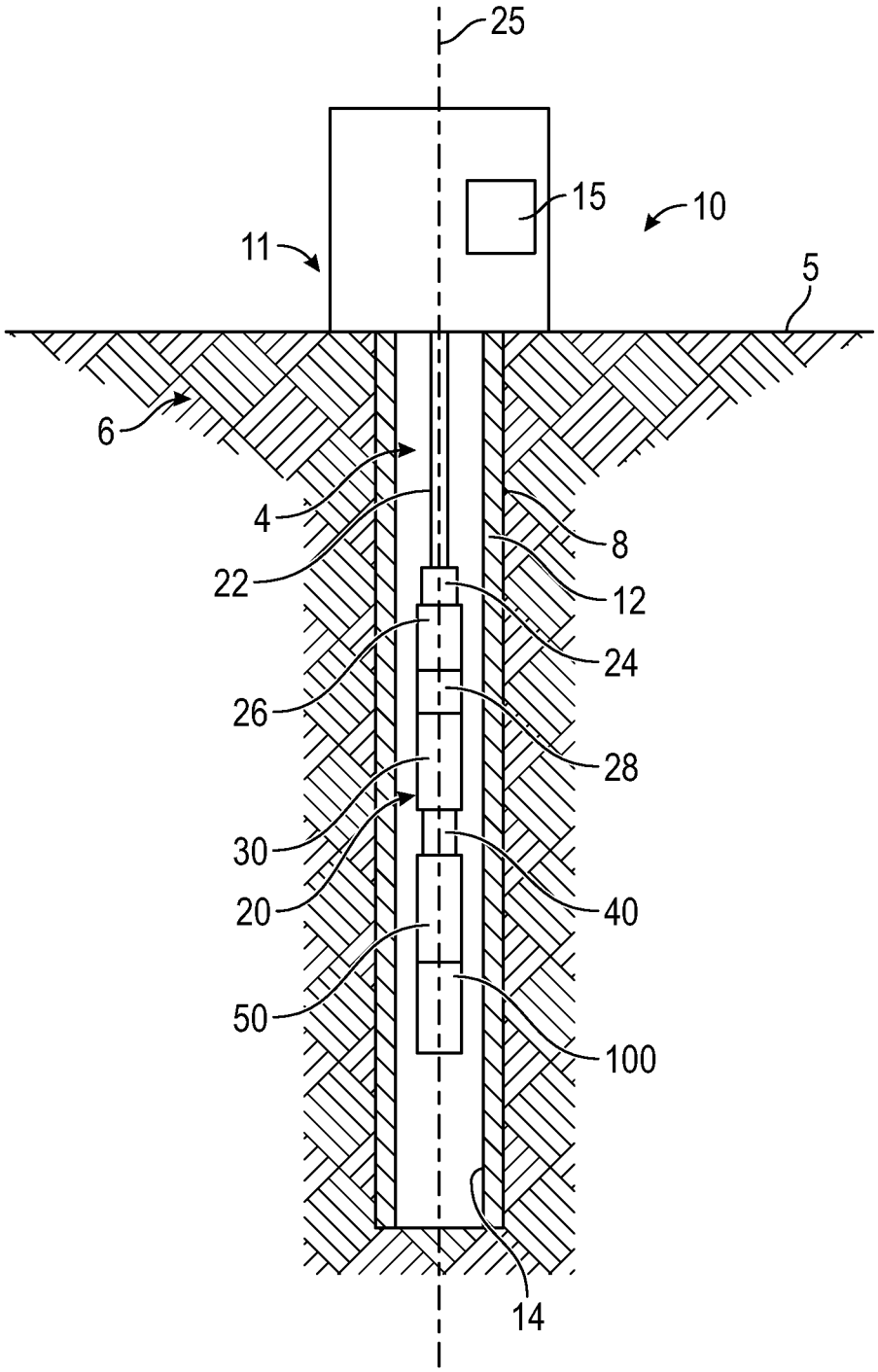
FIGS. 1, 2 are a schematic, partial cross-sectional view of a system for completing a subterranean well including an embodiment of a downhole plug in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial"

and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

As described above, a downhole sealing device or plug may be employed to isolate a portion of a wellbore as part of completion operation. The downhole plug may include one or more slips actuated to engage an inner surface of a casing string to thereby affix the plug to the casing string. Each slip of the downhole plug may comprise a plurality of circumferentially spaced slip segments positioned about a centrally positioned mandrel of the downhole plug.

Downhole plugs may also comprise an annular, elastomeric sealing element configured to sealingly engage the casing string and thereby fluidically isolate or seal a portion of the wellbore extending uphole from the installed downhole plug (the "uphole portion") from a portion of the wellbore extending downhole from the installed downhole plug (the "downhole portion"). As the downhole plug is actuated from a run-in configuration to an set configuration in sealing engagement with the casing string, the plurality of slip segments of each slip expand radially outwards, forming or increasing arcuate openings between each slip segments into which portions of the sealing element may enter and become trapped between. The trapping of portions of the sealing element arcuately between adjacently positioned slip segments of each slip of the downhole plug may reduce the sealing integrity formed between the sealing element and the casing string, potentially preventing the downhole plug from effectively isolating the uphole portion of the wellbore from the downhole portion thereof during the performance of a hydraulic fracturing operation.

Accordingly, embodiments of downhole sealing devices or plugs disclosed herein may comprise a slip assembly including a plurality of first slip segments and a plurality of second slip segments each circumferentially spaced about a central axis of the slip assembly, wherein each second slip segment may comprise an anti-extrusion member configured to prevent or at least mitigate the migration of portions of the sealing element into arcuate gaps formed between adjacent slip segments of the slip assembly. In this manner, adequate sealing integrity may be maintained between the sealing element of the downhole plug and the casing string to ensure the uphole portion of the wellbore remains fluidically isolated from the downhole portion thereof during the performance of a hydraulic fracturing operation.

Figure 2:
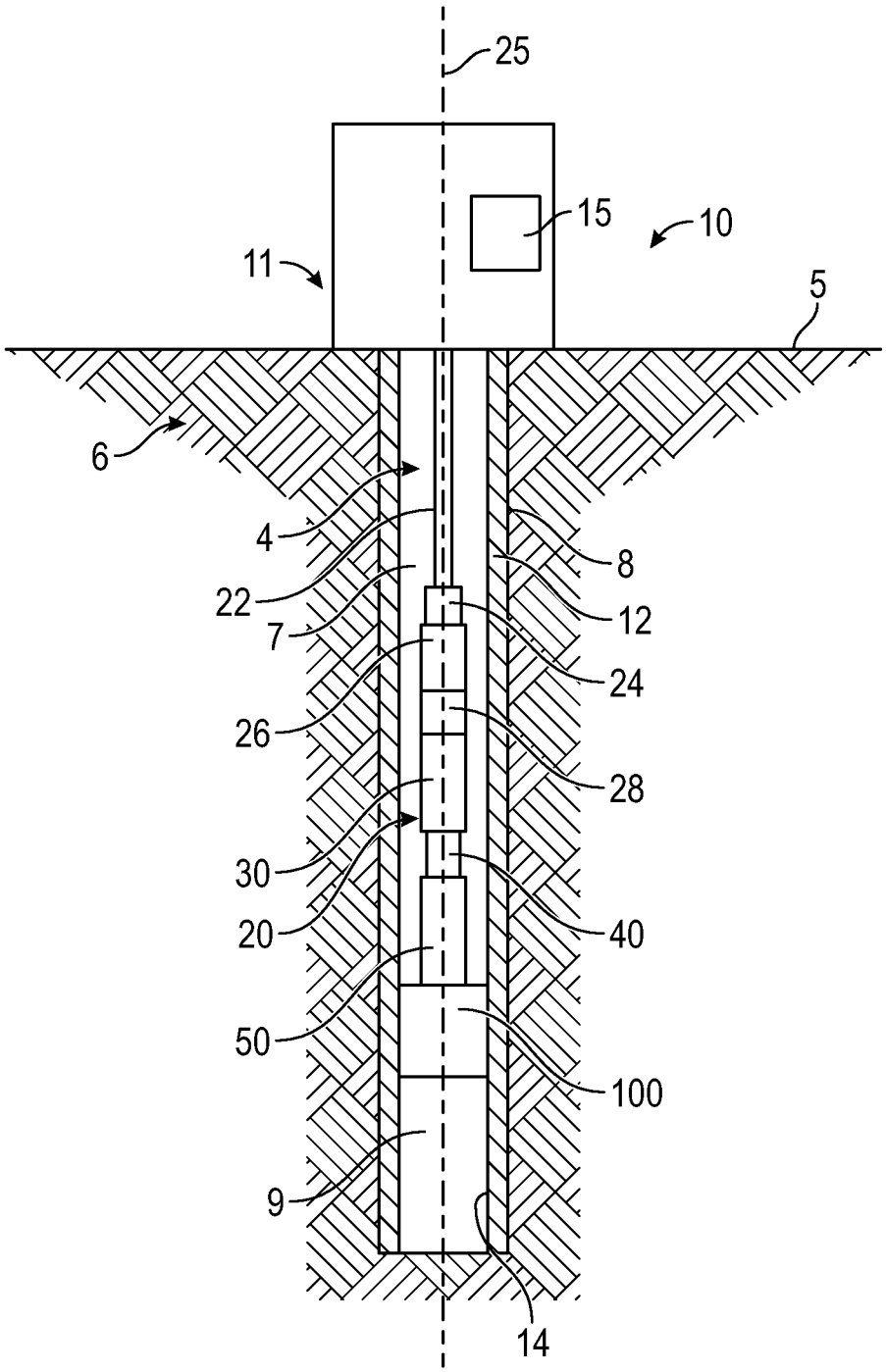
Figure 3:
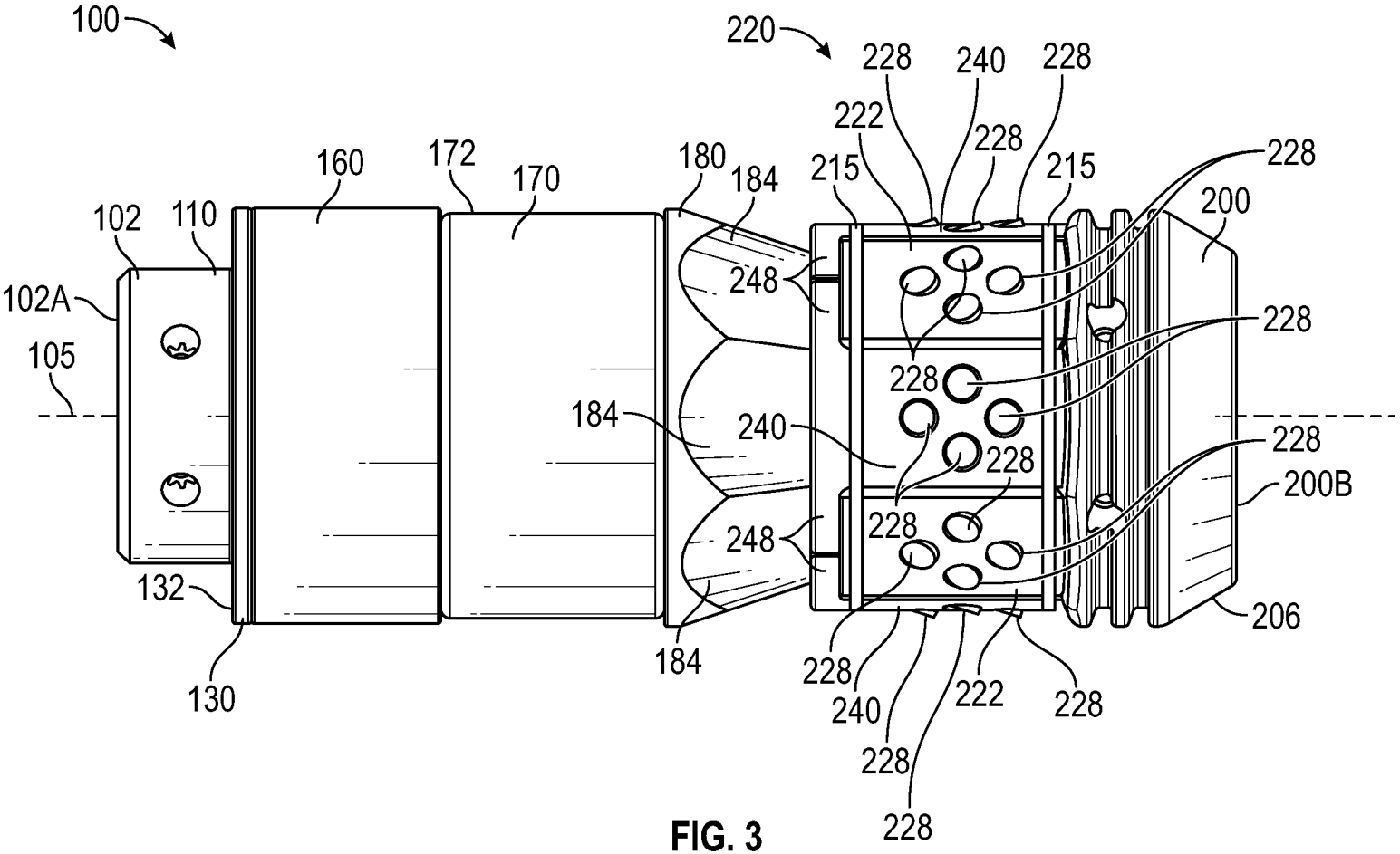
FIG. 3 is a side view of the downhole plug of FIGS. 1, 2.
Figure 4:
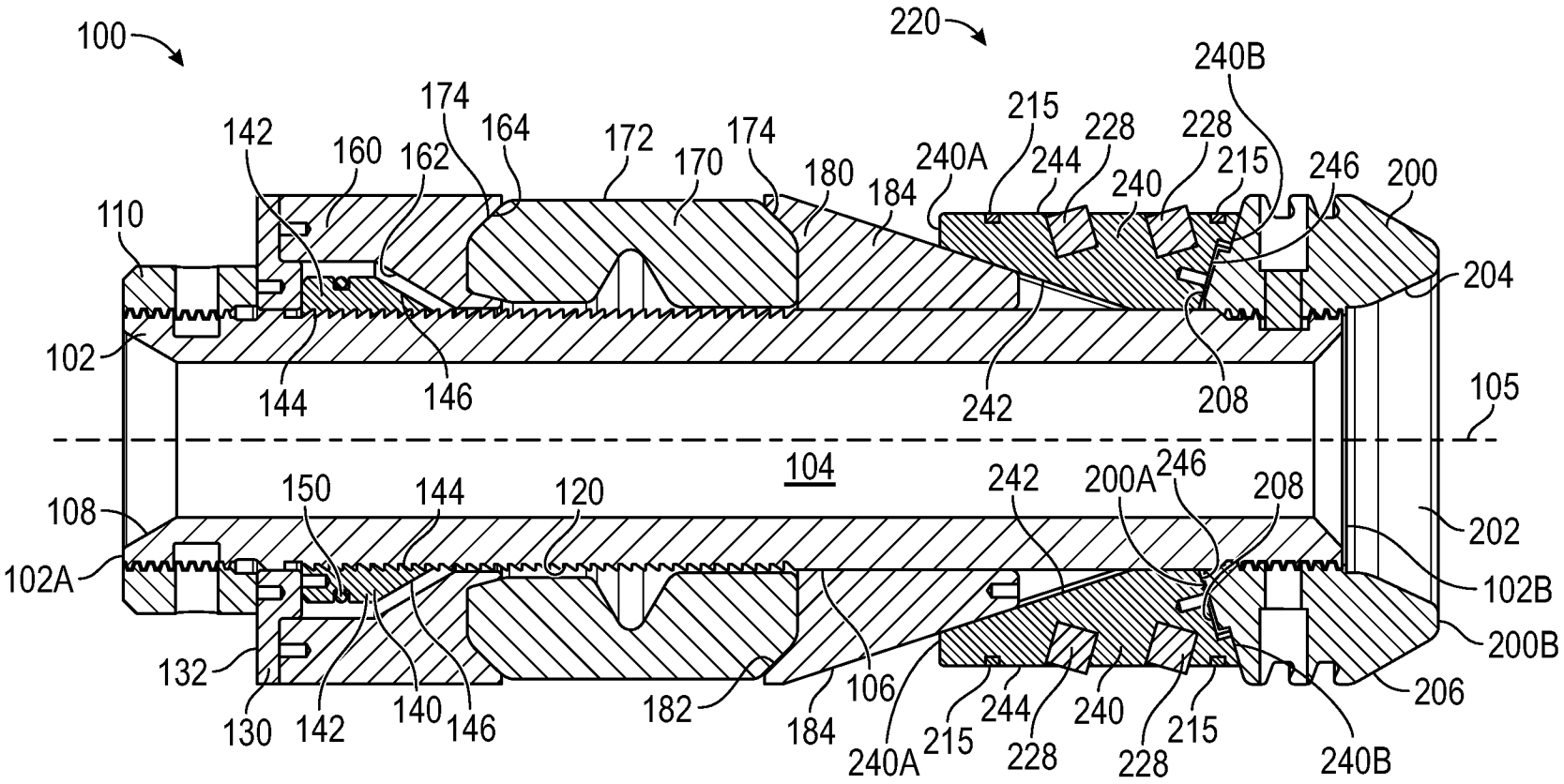
FIG. 4 is first side cross-sectional view of the downhole plug of FIGS. 1, 2.
Figure 5:
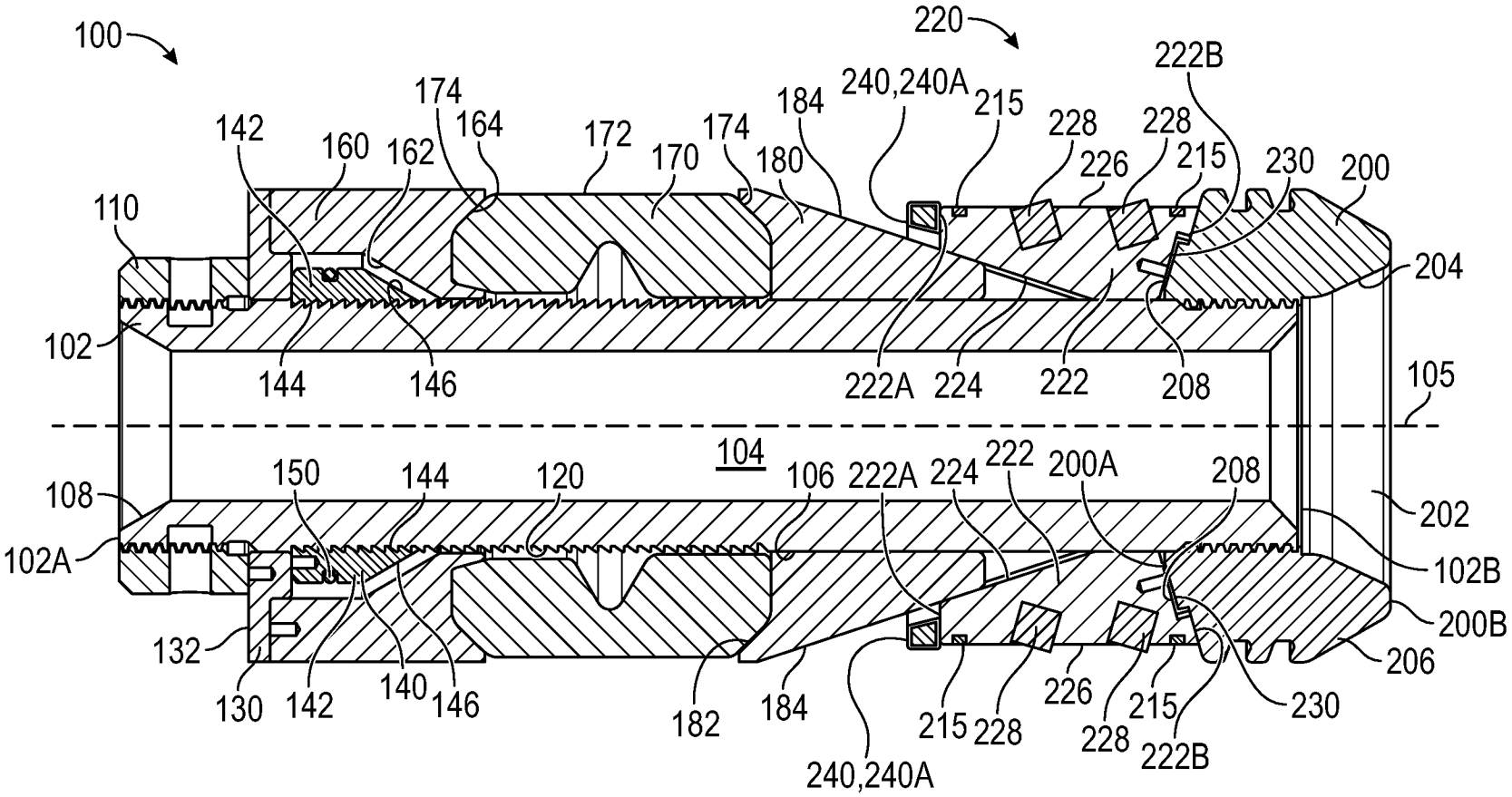
FIG. 5 is second side cross-sectional view of the downhole plug of FIGS. 1, 2.

Referring now to FIGS. 1, 2, a completion system 10 for completing a wellbore 4 extending into a subterranean formation 6 is shown. In the embodiment of FIGS. 1, 2, wellbore 4 is a cased wellbore including a casing string 12 having a generally cylindrical inner surface 14 and which is secured to an inner surface 8 of the wellbore 4 using cement (not shown). In some embodiments, casing string 12 generally includes a plurality of tubular segments coupled together via a plurality of casing collars. Completion system 10 includes a surface assembly 11 positioned at a wellsite 13 of system 10, and a tool string 20 deployable into wellbore 4 from a surface 5 using surface assembly 11. Surface assembly 11 may comprise any suitable surface equipment for drilling, completing, and/or operating well 20 and may include, in some embodiments, derricks, structures, pumps, electrical/mechanical well control components, etc. Tool string 20 of completion system 10 may be suspended within wellbore 4 from a wireline 22 that is extendable from surface assembly 11. Wireline 22 comprises an armored cable and includes at least one electrical conductor for transmitting power and electrical signals between tool string 20 and a control system or firing panel 15 of surface assembly 11 positioned at the surface 5.

In some embodiments, system 10 may further include suitable surface equipment for drilling, completing, and/or operating completion system 10 and may include, for example, derricks, structures, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 has a central or longitudinal axis 25 and generally includes a cable head 24, a casing collar locator (CCL) 26, a direct connect sub 28, one or more perforating guns or tools 30, a plug-shoot firing head (PSFH) 40, a setting tool 50, and a downhole sealing device or plug 100. Cable head 24 is the uppermost component of tool string 20 and includes an electrical connector for providing electrical signal and power communication between the wireline 22 and the other components (CCL 26, perforating gun 30, PSFH 40, setting tool 50, etc.) of tool string 20. CCL 26 is coupled to a lower end of the cable head 24 and is generally configured to transmit an electrical signal to the surface via wireline 22 when CCL 26 passes through a casing collar of casing string 12. In some embodiments, the signal transmitted by CCL 26 may be recorded at surface assembly 11 as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including perforating gun 30 and associated tools, such as the setting tool 50 and downhole plug 100.

Perforating gun 30 of tool string 20 is coupled to direct connect sub 28 and, as will be discussed further herein, is generally configured to perforate casing string 12 and provide for fluid communication between formation 6 and wellbore 4. Particularly, perforating gun 30 may include a plurality of shaped charges that may be detonated by one or more electrical signals conveyed by the wireline 22 from the firing panel 15 of surface assembly 11 to produce one or more explosive jets directed against casing string 12. Perforating gun 30 may comprise a wide variety of sizes such as, for example, 2¾", 3⅛", or 3⅜", wherein the above listed size designations correspond to an outer diameter of perforating gun 30. PSFH 40 of tool string 20 is coupled to a lower end of perforating gun 30. PSFH 40 couples the perforating gun 30 of the tool string 20 to the setting tool 50 and downhole plug 100 and is generally configured to pass a signal from the wireline 22 to the setting tool 50 of tool string 20. PSFH 40 may also include electrical components to fire the setting tool 50 of tool string 20. In some embodiments, tool string 20 may not include PSFH 40, and instead, perforating gun 30 may control the operation of setting tool 50.

In this embodiment, tool string 20 further includes setting tool 50 and downhole plug 100, where setting tool 50 is coupled to a lower end of PSFH 40 and is generally configured to set or install downhole plug 100 within casing string 12 to fluidically isolate desired segments of the wellbore 4. Particularly, setting tool 50 may actuate downhole plug 100 from a first or run-in configuration (shown in FIG. 1) where fluid is permitted to flow across downhole plug 100 to a second or set configuration (shown in FIG. 2) where the downhole plug 100 sealingly engages the inner surface 14 of casing string 12. Thus, setting tool 50 may expand an outer diameter of downhole plug 100 when actuating the downhole plug 100 from the run-in configuration to the set configuration. In some embodiments, setting tool 50 may be operated to actuate downhole plug 100 between the run-in and set configurations in response to the transmission of a firing signal from firing-panel 15 to setting tool 50.

With downhole plug 100 in the set configuration, downhole plug 100 divides wellbore 4 into an uphole portion 7 (shown in FIG. 2) extending uphole from downhole plug 100 to the surface 5 and a downhole portion 9 (shown in FIG. 2) extending from downhole plug 100 to a terminal end or toe (not shown in FIGS. 1, 2) of wellbore 4. In the set configuration, fluid configuration may be restricted between the uphole portion 7 and the downhole portion 4. Following the actuation of downhole plug 100 into the set configuration, the perforating gun 30 of tool string 20 may be actuated to form a plurality of perforations in casing string 12 through which the formation 6 may be subsequently fractured by pressurized fluid pumped into wellbore 4 from the surface 5.

Referring to FIGS. 3-9, an embodiment of the downhole plug 100 of the tool string 20 of FIGS. 1, 2 is shown in FIGS. 3-9. In the embodiment of FIGS. 3-9, downhole plug 100 has a central or longitudinal axis 105 and may generally include a mandrel 102, an engagement disk 130, a body lock ring assembly 140, a first clamping member 160, an elastomeric member or packer 170, a second clamping member 180, a nose cone 200, and a slip assembly 220.

The mandrel 102 of downhole plug 100 has a first end 102A, a second end 1026, a central bore or passage 104 defined by a generally cylindrical inner surface extending between ends 102A, 102B, and a generally cylindrical outer surface 106 extending between ends 102A, 102B. In this embodiment, the inner surface of mandrel 102 may include a frustoconical seat 108 proximal first end 102A that may receive an obturating member (e.g., a ball, dart, etc.) for restricting downhole (e.g., in the direction of second end 102B from first end 102A) through the central passage 104 of mandrel 102. For example, following the actuation of downhole plug 100 into the set configuration, an obturating member may be pumped into wellbore 4 and through uphole portion 7 for seating against seat 108 such that fluid flow through central bore 104 of mandrel 102 is restricted, thereby preventing fluid flow from the uphole portion 7 of wellbore to the downhole portion 7 thereof. In this embodiment, an expanded diameter portion or collar 110 is coupled to the outer surface 106 of mandrel 102 at first end 102A, the collar 110 forming an annular shoulder at first end 102A. Collar 110 includes a plurality of circumferentially spaced apertures configured to receive a plurality of connecting members (not shown in FIGS. 3-9) for coupling collar 110 and mandrel 102 with setting tool 50. Additionally, mandrel 102 includes a plurality of ratchet teeth 120 that extend along a portion of outer surface 106.

Engagement disk 130 of downhole plug 100 is disposed about mandrel 102 and may have a first end comprising an annular engagement surface 132 configured to engage a corresponding annular engagement surface of setting tool 50 for actuating downhole plug 100 from the run-in configuration to the set configuration, as will be discussed further herein. In the run-in configuration of downhole plug 100, engagement surface 132 of engagement disk 130 may be disposed directly adjacent or contact collar 110.

In this embodiment, the body lock ring assembly 140 of downhole plug 100 may comprise a plurality of circumferentially spaced arcuate lock ring segments 142 disposed about mandrel 102, and an annular lock ring retainer 150 disposed about lock ring segments 142. Each lock ring segment 142 may include an arcuate inner surface that comprises a plurality of ratchet teeth 144. Ratchet teeth 144 may matingly engage the ratchet teeth 120 of mandrel 102 to restrict relative axial movement between lock ring segments 142 and mandrel 102.

Particularly, the mating engagement between ratchet teeth 144 of lock ring segments 142 and ratchet teeth 120 of mandrel 102 prevent lock ring segments 142 from travelling axially towards the first end 102A of mandrel 102, but permits lock ring segments 142 to travel axially towards the second end 102B of mandrel 102. Thus, ratchet teeth 120, 144 may act as a one-way ratchet permitting relative axial movement between mandrel 102 and lock ring assembly 140 in a single direction. Additionally, each lock ring segment 142 may include an outer surface that comprises an arcuate groove and a generally frustoconical surface 146. Lock ring retainer 150 may retain lock ring segments 142 in position about mandrel 102 such that segments 142 do not move axially relative to each other.

First clamping member 160 of downhole plug 100 is generally annular and is disposed about mandrel 102 between engagement disk 130 and packer 170. In this embodiment, first clamping member 160 has a generally cylindrical inner surface that may include a first frustoconical surface 162 located proximal a first end thereof and a second frustoconical surface 164 extending from a second end thereof. Additionally, as will be described further herein, the first frustoconical surface 162 of first clamping member 160 may be configured to matingly engage the frustoconical surface 146 of each lock ring segment 142 when downhole plug 100 is set in wellbore 4.

Packer 170 of downhole plug 100 is generally annular and disposed about mandrel 102 between first clamping member 160 and second clamping member 180. Packer 170 comprises an elastomeric material configured to sealingly engage the inner surface 14 of casing string 12 when downhole plug 100 is actuated from the run-in configuration to the set configuration. In this embodiment, packer 170 comprises a generally cylindrical outer surface 172 extending between first and second ends of packer 170. Outer surface 172 of packer 170 may include a pair of frustoconical surfaces 174 extending from each end of packer 170.

Second clamping member 180 of downhole plug 100 is generally annular and is disposed about mandrel 102 between packer 170 and slip assembly 220. In this embodiment, second clamping member 180 has a generally cylindrical inner surface that may include an inner frustoconical surface 182 extending from a first end of second clamping member 180. Additionally, second clamping member 180 may include a generally cylindrical outer surface that includes a plurality of circumferentially spaced planar (e.g., flat) surfaces 184 extending from a second end of second clamping member 180. Each planar surface 184 extends at an angle relative to the central axis 105 of downhole plug 100.

Nose cone 200 of downhole plug 100 is generally annular and is disposed about the second end 102B of mandrel 102. Nose cone 200 has a first end 200A, a second end 200B opposite first end 200A, a central bore or passage 202 defined by a generally cylindrical inner surface 204 extending between ends 200A, 200B, and a generally cylindrical outer surface 206 extending between ends 200A, 200B. In this embodiment, the inner surface 204 of nose cone 200 includes a connector that releasably or threadably couples with a connector of mandrel 102 to restrict relative axial movement between mandrel 102 and nose cone 200; however, in other embodiments, nose cone 200 may be coupled to mandrel 102 through various means. In still other embodiments, nose cone 200 may be formed integrally with mandrel 102. In this embodiment, nose cone 200 may include a plurality of circumferentially spaced protrusions or notches 208 extending axially from first end 200A of nose cone 200. As will be discussed further herein, protrusions 208 of nose cone 200 are configured to interlock with slip assembly 220 to thereby restrict relative rotation between slip assembly 220 and nose cone 200. In other embodiments, nose cone 200 may not include protrusions 208.

Slip assembly 220 of downhole plug 100 has a central or longitudinal axis coaxial with central axis 105 and is generally configured to engage or "bite into" the inner surface 14 of casing string 12 when downhole plug 100 is actuated into the set configuration to couple or affix downhole plug 100 to casing string 12, thereby restricting relative axial movement between downhole plug 100 and casing string 12, and permitting downhole plug 100 to maintain a differential pressure between uphole portion 7 and downhole portion 9 of wellbore 4. In this embodiment, slip assembly 220 may comprise a plurality of circumferentially spaced arcuate first slip segments 222 disposed about mandrel 102, a plurality of circumferentially spaced arcuate second slip segments 240, and a pair of axially spaced annular retainers 215 each disposed about the first slip segments 222 and second slip segments 240. Slip segments 222, 240 are positioned alternatingly about the circumference of mandrel 102 such that a first slip segment 222 is positioned between each pair of adjacently disposed second slip segments 240. Although in this embodiment slip assembly 220 is used with downhole plug 100, in other embodiments slip assembly 220 may be used with other downhole sealing devices other than plugs. Additionally, while in this embodiment downhole plug 100 comprises a single slip assembly 220, in other embodiments, downhole plug 100 may comprise two or more slip assemblies 220.

As will be described further herein, retainers 215 act to retain the slip segments 222, 240 of slip assembly 220 in a first or radially inner position relative central axis 105 corresponding to the run-in configuration of downhole plug 100. As will be described further herein, retainers 215 are configured to snap upon actuation of downhole plug 100 from the run-in configuration to the set configuration to permit the slip segments 222, 240 of slip assembly 220 to actuate or displace into a second or radially outer position relative central axis 105. Although in this embodiment downhole plug 100 comprises retainers 215 for securing slips 222, 240 in the radially inner position, in other embodiments, downhole plug 100 may not include retainers 215.

Figure 6:
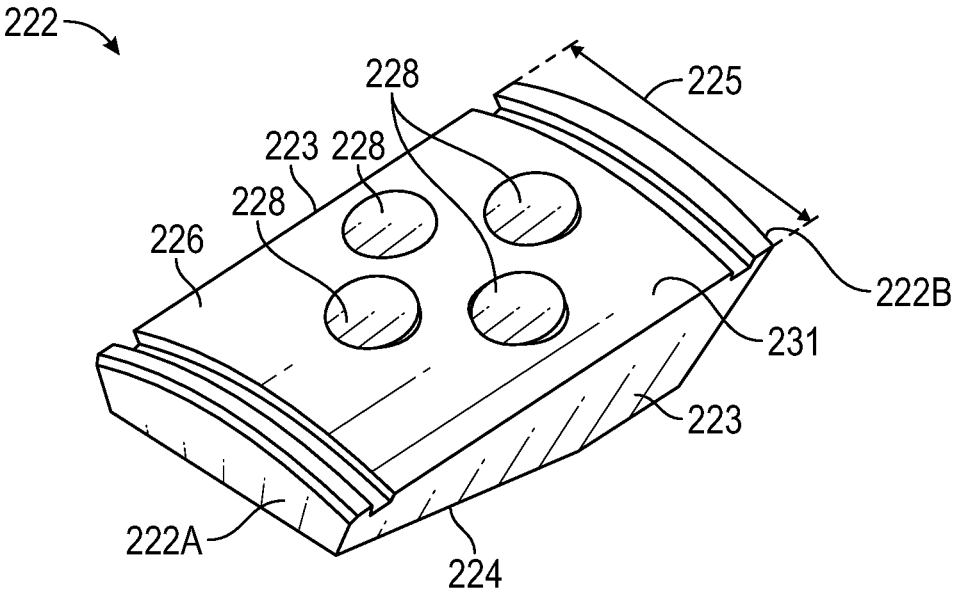
FIGS. 6, 7 are perspective views of an embodiment of a first slip segment of a slip assembly of the downhole plug of FIG. 3.
Figure 7:
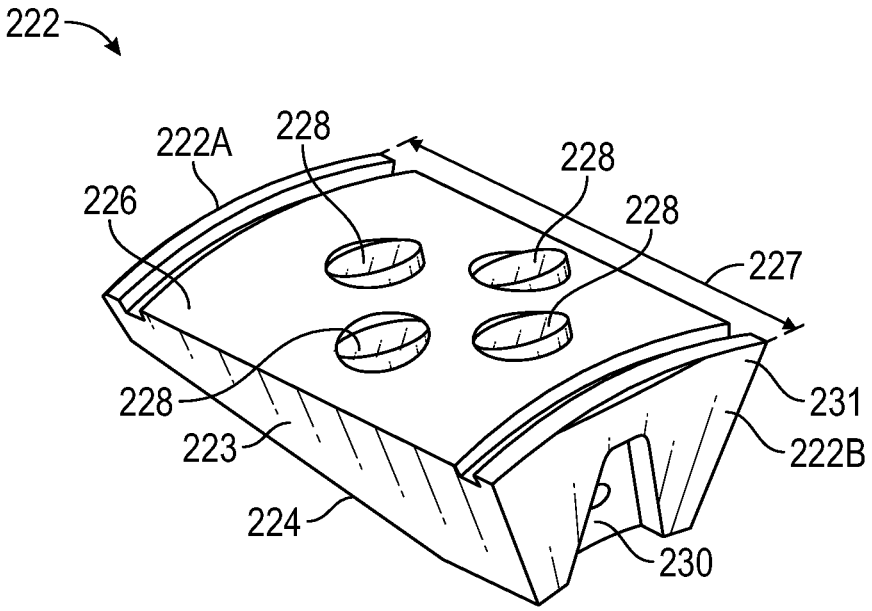

As shown particularly in FIGS. 6, 7, each first slip segment 222 of slip assembly 220 comprises a body 231 having a first end 222A, a second end 222B, and an inner surface extending between ends 222A, 222B that may include a planar (e.g., flat) surface 224 extending from first end 222A towards second end 222B. In some embodiments, the body 227 of each first slip segment 222 may comprise a dissolvable material such as a dissolvable magnesium, aluminum, polymer, composite, plastic, etc.; however, in other embodiments, the material composition of body 227 may vary. For instance, in other embodiments, body 227 may comprise a non-dissolvable material. The planar surface 224 of the body 231 of each first slip segment 222 may extend at a non-zero angle (e.g., an acute angle) relative to central axis 105 of downhole plug 100 and may be configured to matingly engage one of the planar surfaces 184 of second clamping member 180. The planar (e.g., flat) interface formed between each corresponding planar surface 184 of clamping member 180 and each planar surface 224 of first slip segments 222 may restrict relative rotation between second clamping member 180 and first slip segments 222. Additionally, the body 231 of each first slip segment 222 may include a pair of opposing lateral sides 223 each extending from first end 222A and second end 222B of the first slip segment 222. Ends 222A, 222B of each first slip segment 222 define an axial length 227 of the first slip segment 222 while lateral sides 223 define a lateral width 225 of the first slip segment 222.

In this embodiment, an arcuate outer surface 226 of the body 231 of each first slip segment 222 may include a plurality of openings or receptacles each receiving an insert or engagement member 228 that matingly engages or couples with the body 231. Engagement members 228 are configured to engage or bite into the inner surface 14 of casing string 12 when downhole plug 100 is actuated into the set configuration to thereby affix downhole plug 100 to casing string 12 at a desired or predetermined location. In this embodiment, engagement members 228 comprise a suitable material for engaging with inner surface 14 of casing string 12 during operations. For example, engagement members 228 may comprise a ceramic material, 8620 Chrome-Nickel-Molybdenum alloy, carbon steel, tungsten carbide, cast iron, and/or tool steel; however, in other embodiments, engagement members 228 may comprise various materials. For example, in other embodiments, engagement members 228 may comprise a dissolvable magnesium, aluminum, polymer, composite, plastic, etc. In still other embodiments, each first slip segment 222 may not include a separately formed engagement member 228, and instead may include a plurality of engagement members formed integrally or monolithically with the body 231 of the first slip segment 222.

In this embodiment, each engagement member 228 comprises a generally cylindrical button having a central or longitudinal axis which extends at a non-zero angle relative to the central axis 105 of downhole plug 100. For example, the central axis of each engagement member 228 may be oriented in the direction of an upper end of downhole plug 100 defined by the upper end 102A of mandrel 100. As will be discussed further herein, in other embodiments, the configuration of each engagement member 228 may vary. Additionally, the plurality of engagement members 228 of each first slip segment 222 may be oriented in a predefined formation or pattern on outer surface 226, such as a diamond formation as shown in FIGS. 6, 7; however, in other embodiments, engagement members 228 may be positioned in various patterns (or randomly) on outer surface 226. In still other embodiments, each first slip segment 222 may include only a single engagement member 228.

In this embodiment, each first slip segment 222 of slip assembly 220 may include a pocket or receptacle 230 located at the second end 222B which extends into the inner surface of the first slip segment 222. The pocket 230 of each first slip segment 222 is configured to matingly receive one of the protrusions 208 of nose cone 200 to form an interlocking engagement therebetween, thereby restricting relative rotation between the first slip segment 222 of slip assembly 220 and nose cone 200. In other embodiments, first slip segments 222 may not include pockets 230.

Figure 8:
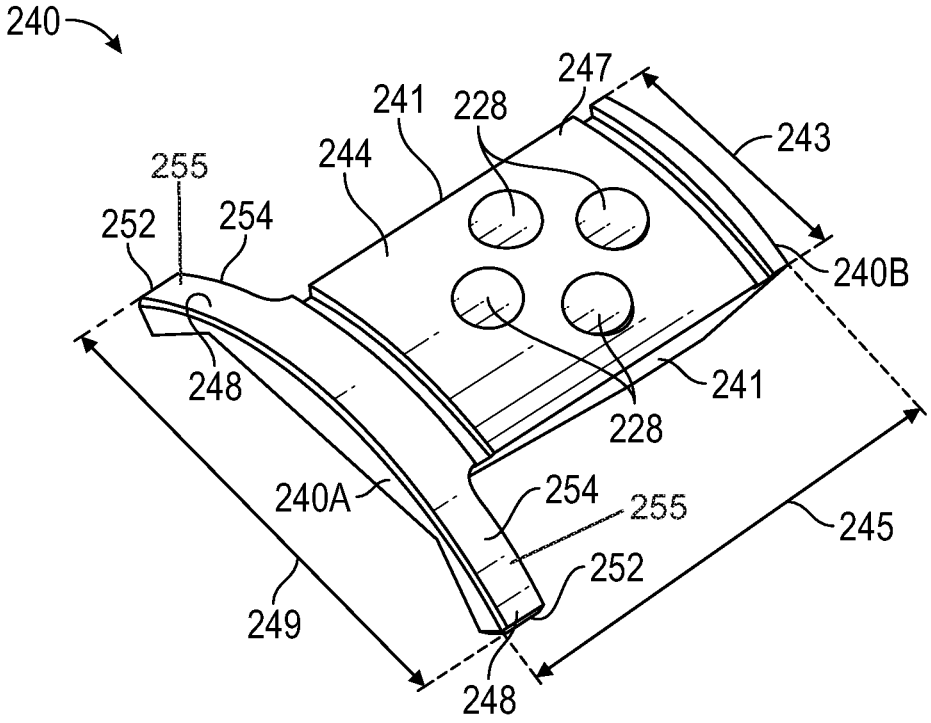
FIGS. 8, 9 are perspective views of an embodiment of a second slip segment of a slip assembly of the downhole plug of FIG. 3.
Figure 9:
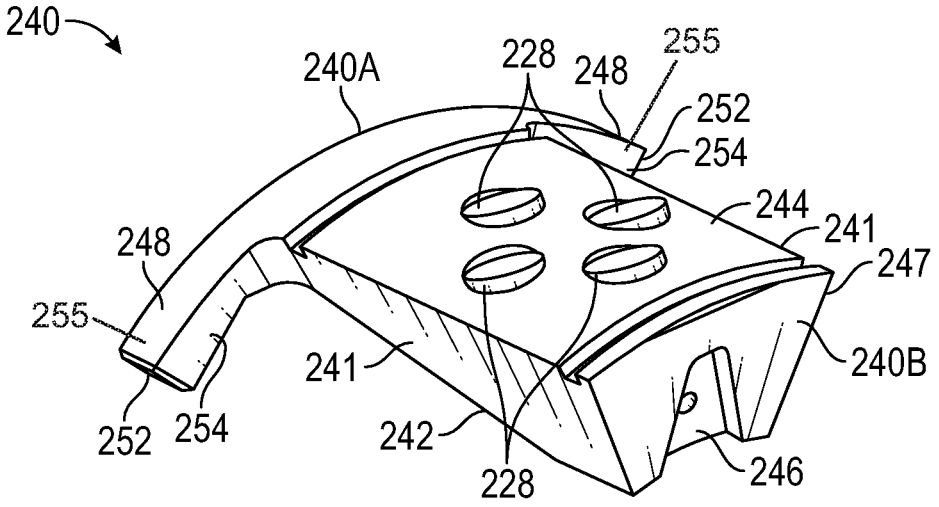

As shown particularly in FIGS. 8, 9, each second slip segment 240 of slip assembly 220 comprises a body 247 having a first end 240A, a second end 240B, and an inner surface extending between ends 240A, 240B that includes a planar (e.g., flat) surface 242 extending from first end 240A. In some embodiments, the body 247 of each second slip segment 240 may comprise a dissolvable material such as a dissolvable magnesium, aluminum, polymer, composite, plastic, etc.; however, in other embodiments, the material composition of body 247 may vary. For instance, in other embodiments, body 247 may comprise a non-dissolvable material. The planar surface 242 of the body 247 of each second slip segment 240 extends at an angle relative to central axis 105 of downhole plug 100 and is configured to matingly engage one of the planar surfaces 184 of second clamping member 180, similar in manner to the planar surface 224 of each first slip segment 222. Additionally, the body 247 of each second slip segment 240 includes a pair of opposing lateral sides 241 each extending from first end 240A and second end 240B of the second slip segment 240. Ends 240A, 240B of each second slip segment 240 define an axial length 245 of the second slip segment 240 while lateral sides 241 define a lateral width of the second slip segment 240.

In this embodiment, an arcuate outer surface 244 of the body 247 of each second slip segment 240 includes a plurality of openings or receptacles each receiving an insert or engagement member 228 that matingly engages or couples with the body 247. In other embodiments, each second slip segment 240 may not include a separately formed engagement member 228, and instead may include a plurality of engagement members formed integrally or monolithically with the body 247 of second slip segment 240. In this embodiment, each second slip segment 240 of slip assembly 220 may include a pocket or receptacle 246 located at the second end 240B which extends into the inner surface of the second slip segment 240. The pocket 246 of each second slip segment 240 is configured to matingly receive one of the protrusions 208 of nose cone 200 in a manner similar to the interlocking engagement formed between the pocket 230 of each first slip segment 222 and the protrusions 208 of nose cone 200. In other embodiments, the second slip segments 240 of slip assembly 220 may not include pockets 246.

In this embodiment, each second slip segment 240 may include a pair of arcuately extending anti-extrusion members 248 positioned at first end 240A and extending arcuately or laterally from sides 241 of the body 247 of the second slip segment 240. In some embodiments, the anti-extrusion member 248 of each second slip segment 240 may be integrally or monolithically formed with body 247; however, in other embodiments, the anti-extrusion member 248 of each second slip segment 240 may be coupled (e.g., molded, welded, coupled via one or more fasteners, etc.) to the second body 247 whereby relative movement between the anti-extrusion member 248 and second body 247 is restricted. Although in this embodiment each second slip segment 240 includes a pair of anti-extrusion members 248, in other embodiments, each second slip segment 240 may include a single anti-extrusion member 248 or more than two anti-extrusion members 248. In this embodiment, each anti-extrusion member 248 comprises a pair of elongate wings or arms 255 (shown in FIGS. 8, 9) positioned at the first end 240A and extending arcuately in opposing directions and having a curved outer surface generally co-planar with outer surface 244 and a planar (e.g., flat) inner surface 250 disposed at a non-zero angle to planar surface 242. In this configuration, inner surfaces 250 of anti-extrusion members 248 are configured to matingly engage the planar surfaces 184 of second clamping member 180 positioned adjacent the planar surface 184 engaged by planar surface 242.

Each anti-extrusion member 248 includes a terminal end 252 distal the lateral side 241 of second slip segment 240 from which the anti-extrusion member 248 projects. A lateral width 249 extending between the terminal ends 252 of the opposed anti-extrusion members 248 of each second slip segment 240 defines a maximum width of the second slip segment 240 which is greater than width 243 extending between lateral sides 241 of the second slip segment 240. Additionally, the lateral width 249 of anti-extrusion members 248 of each second slip segment 240 is greater than a maximum width of each first slip segment 222. In some embodiments, the lateral width 249 of anti-extrusion members 248 is about 100% greater than the maximum width of each first slip segment 222; however, in other embodiments, the difference in lateral width 249 and the maximum width of each first slip segment 222 may vary. Further, a maximum axial length 245 of each second slip segment 240 is greater than a maximum axial length 227 of each first slip segment 222 of slip assembly 200. In this embodiment, each anti-extrusion member 248 includes an anti-extrusion or engagement surface 254 configured to slidably engage the first end 222A of an adjacently positioned first slip segment 222, as will be discussed further herein.

Referring briefly to FIGS. 14-18, another embodiment of a downhole sealing device or plug 300 is shown. Downhole plug 300 may be used in lieu of, or in combination with, downhole plug 100 shown in FIGS. 2-13 as part of a tool string (e.g., tool string 20). Additionally, downhole plug 300 includes features in common with downhole plug 100, and shared features are labeled similarly. Particularly, downhole plug 300 is similar to downhole plug 100 described above except that downhole plug 300 includes a slip assembly 310 comprising a plurality of circumferentially spaced arcuate first slip segments 312 disposed about the mandrel 102 of downhole plug 300, and a plurality of circumferentially spaced arcuate second slip segments 320 also disposed circumferentially about mandrel 102. Slip segments 312, 320 are positioned alternatingly about the circumference of mandrel 102 such that a first slip segment 312 is positioned between each pair of adjacently disposed second slip segments 320.

Figure 15:
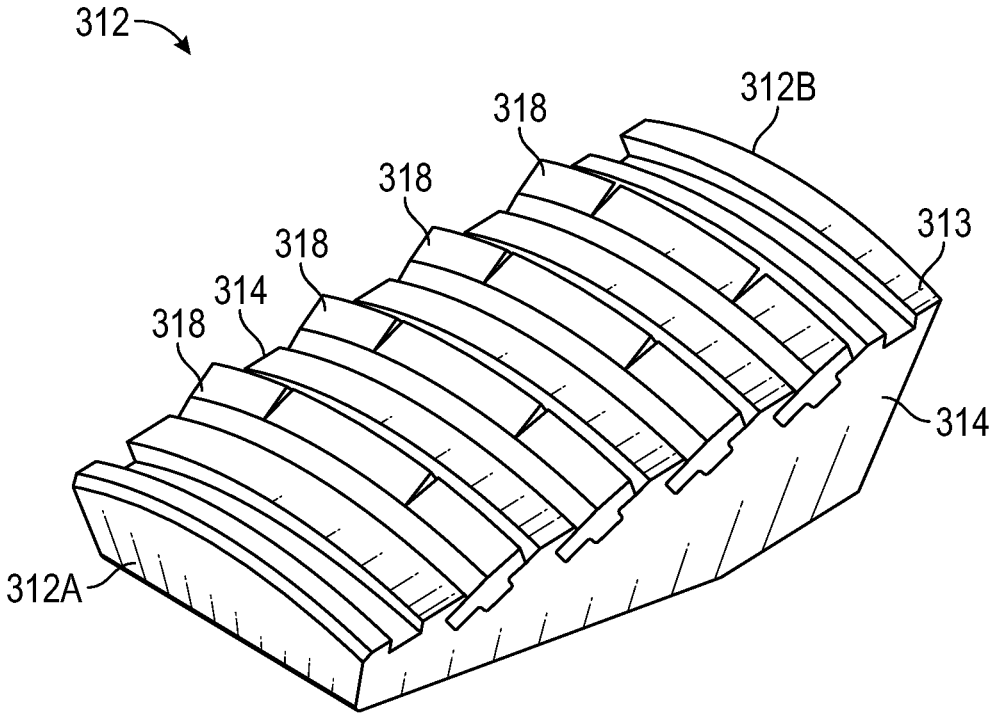
FIGS. 15, 16 are perspective views of an embodiment of a first slip segment of a slip assembly of the downhole plug of FIG. 13.
Figure 16:
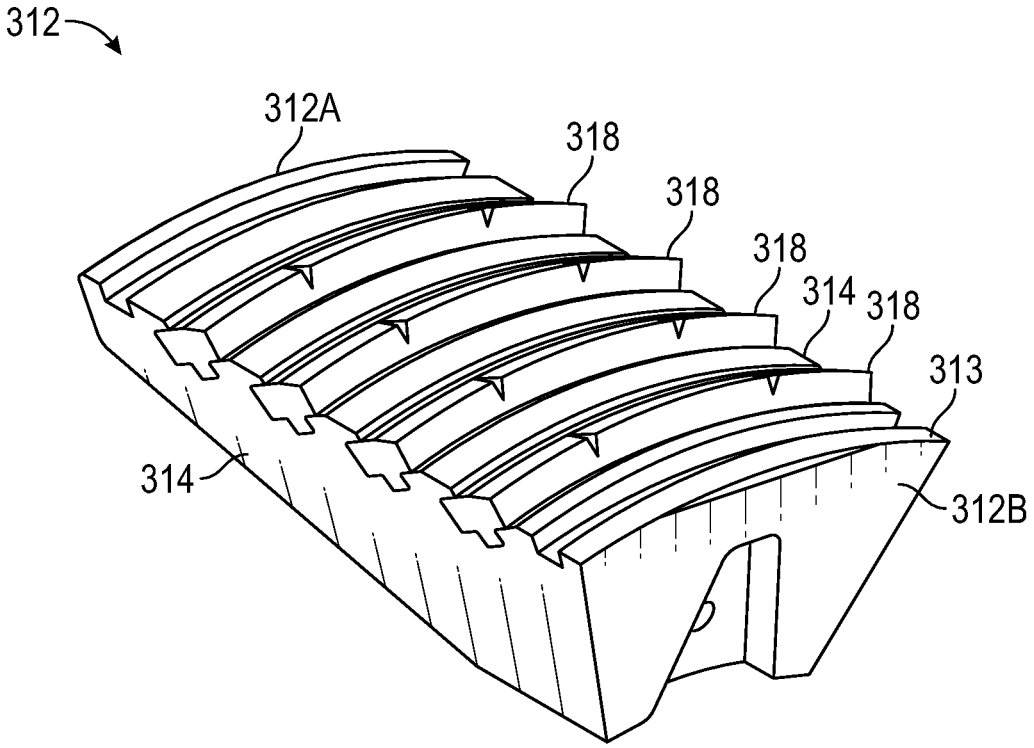

As shown particularly in FIGS. 15, 16, first slip segments 312 of slip assembly 310 share features in common with the first slip segments 222 of slip assembly 220 while second slip segments 320 share features in common with second slip segments 240, and shared features are labeled similarly. Particularly, each first slip segment 312 comprises a body 313 having a first end 312A, a second end 312B, a pair of opposing lateral sides 314, and a radially outer surface 316 (relative a central or longitudinal axis 305 of downhole plug 300) extending arcuately between the pair of sides 314. The outer surface 316 of the body 313 of each first slip segment 312 may include a plurality of grooves extending laterally between sides 314, where each longitudinal groove receives an engagement member 318 extending arcuately about central axis 305. Engagement members 318 are configured to engage or bite into the inner surface 14 of casing string 12 when downhole plug 300 is actuated into the set configuration to thereby affix downhole plug 300 to casing string 12 at a desired or predetermined location. Each engagement member 318 may be formed from a material similar to that comprising engagement members 228 described above. Thus, instead of comprising cylindrical buttons as with engagement members 228, engagement members 318 comprise arcuate blades which may be arranged in rows along a length of the first slip segment 310.

Figure 17:
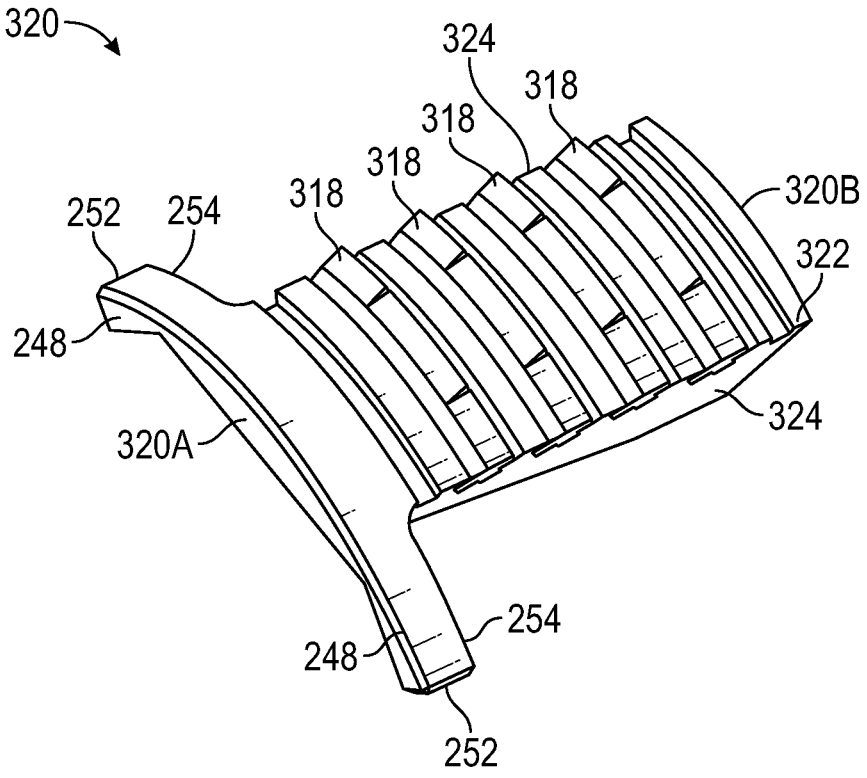
FIGS. 17, 18 are perspective views of an embodiment of a second slip segment of a slip assembly of the downhole plug of FIG. 13.
Figure 18:
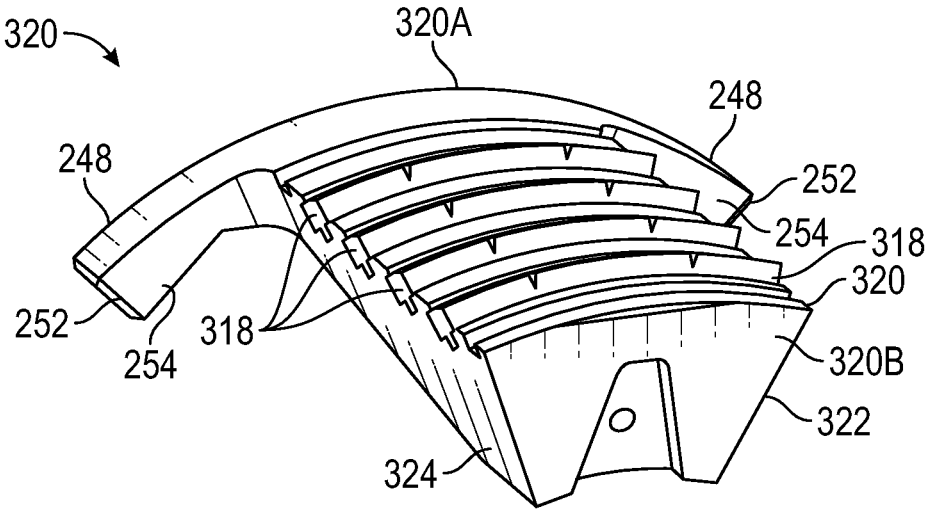

As shown particularly in FIGS. 17, 18, each first slip segment 320 of slip assembly 320 comprises a body 322 having a first end 320A, a second end 320B, a pair of opposing lateral sides 324, and a radially outer surface 326 (relative a central or longitudinal axis 305 of downhole plug 300) extending arcuately between the pair of sides 324. The outer surface 326 of the body 322 of each first slip segment 320 may similarly include a plurality of grooves extending laterally between sides 324, where each longitudinal groove receives one of the engagement members 318.

Referring to FIGS. 1-4, 10-13, as described above, downhole plug 100 is pumped downhole though wellbore 4 along with the other components of tool string 20. As tool string 20 is pumped through wellbore 4, the position of tool string 20 in wellbore 4 is monitored at the surface via signals generated from CCL 26 and transmitted to the surface using wireline 22. Once tool string 20 is disposed in a desired location in wellbore 4, one or more of perforating guns 30 may be fired to perforate casing 12 at the desired location and setting tool 50 may be fired or actuated to actuate downhole plug 100 from the run-in configuration (shown in FIGS. 1, 4, 10, and 11) to the set configuration (shown in FIGS. 12, 13).

Particularly, setting tool 50 includes an inner member or mandrel (not shown) that moves axially relative to an outer member or housing of setting tool 50 upon the actuation of tool 50. The mandrel of setting tool 50 is coupled to mandrel 102 of downhole plug 100 such that the movement of the mandrel of setting tool 50 pulls mandrel 102 uphole (e.g., towards setting tool 50). Additionally, the outer member of setting tool 50 contacts engagement surface 132 of engagement disk 130 to prevent disk 130, clamping members 160, 180, packer 170, and slip assembly 220 from travelling in concert with mandrel 102, thereby providing relative axial movement between mandrel 102 and disk 130, clamping members 160, 180, packer 170, and slip assembly 220.

As mandrel 102 travels uphole towards setting tool 50, the first end 200A of nose cone 200 and the second end 130B of engagement disk 130 apply an axially compressive force against clamping members 160, 180, packer 170, and slip assembly 220. In response to the application of the compressive force, slip segments 222, 240 are forced radially outward towards casing string 12 from the radially inner position as planar surfaces 184 of second clamping member 180 slide along the planar surfaces 224, 242 of slip segments 222, 240, respectively, snapping retainers 215. Slip segments 222, 240 continue to travel radially outwards until engagement members 228 contact and couple to the inner surface 14 of casing string 12, disposing slip segments 222, 240 in the radially outer position and locking downhole plug 100 to casing string 12 at the desired location in wellbore 4. Additionally, each end of packer 170 is compressed via contact between frustoconical surfaces 174 of packer 170 and frustoconical surfaces 164, 182 of clamping members 160, 180, respectively. The axially directed compressive force applied to packer 170 forces the outer surface 172 of packer 170 into sealing engagement with the inner surface 14 of casing string 12. With outer surface 172 of packer 170 sealing against the inner surface 14 of casing string 12, the only fluid flow permitted between the uphole portion 7 and the downhole portion 9 of wellbore 4 across downhole plug 100 is permitted via passage 104 of mandrel 102 when passage 104 is unobstructed.

As the outer surface 172 of packer 170 engages the inner surface 14 of casing string 12, pressure between outer surface 172 and inner surface 14 urges a portion of packer 170 in an axial direction relative second clamping member 180 towards nose cone 200. In other words, pressure applied to the outer surface 172 of packer 170 by the inner surface 14 of casing string 12 acts to extrude a portion of packer 170 axially between second clamping member 180 and casing string 12. The anti-extrusion members 248 of the second slip segments 240 of slip assembly 220 act to limit the amount of packer 170 that is axially extruded between second clamping member 180 and casing string 12, thereby maintaining the sealing integrity between packer 170 and casing string 12 required for hydraulically fracturing the formation 6.

Figure 10:
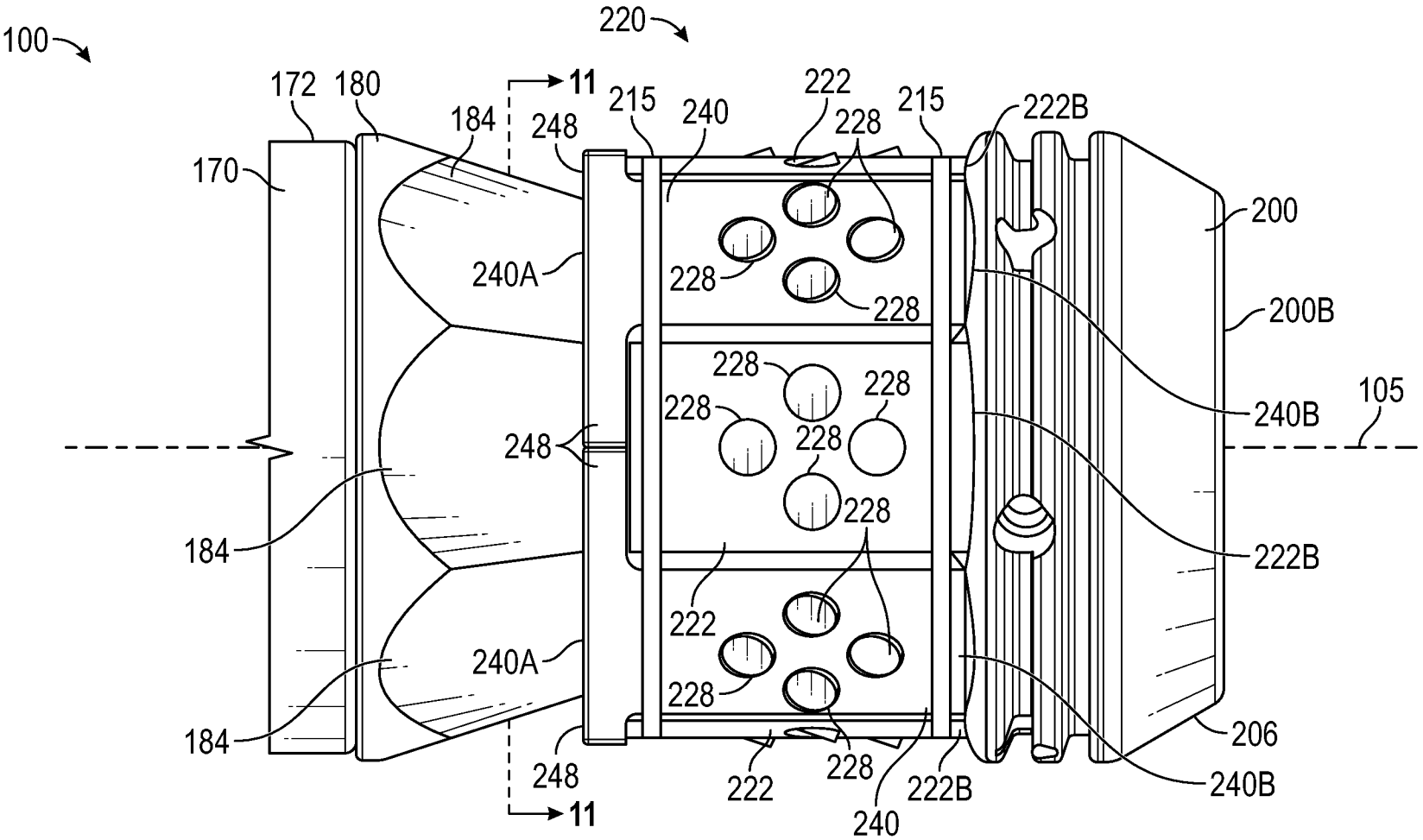
FIG. 10 is a partial side view of the downhole plug of FIG. 3 in a run-in configuration.
Figure 11:
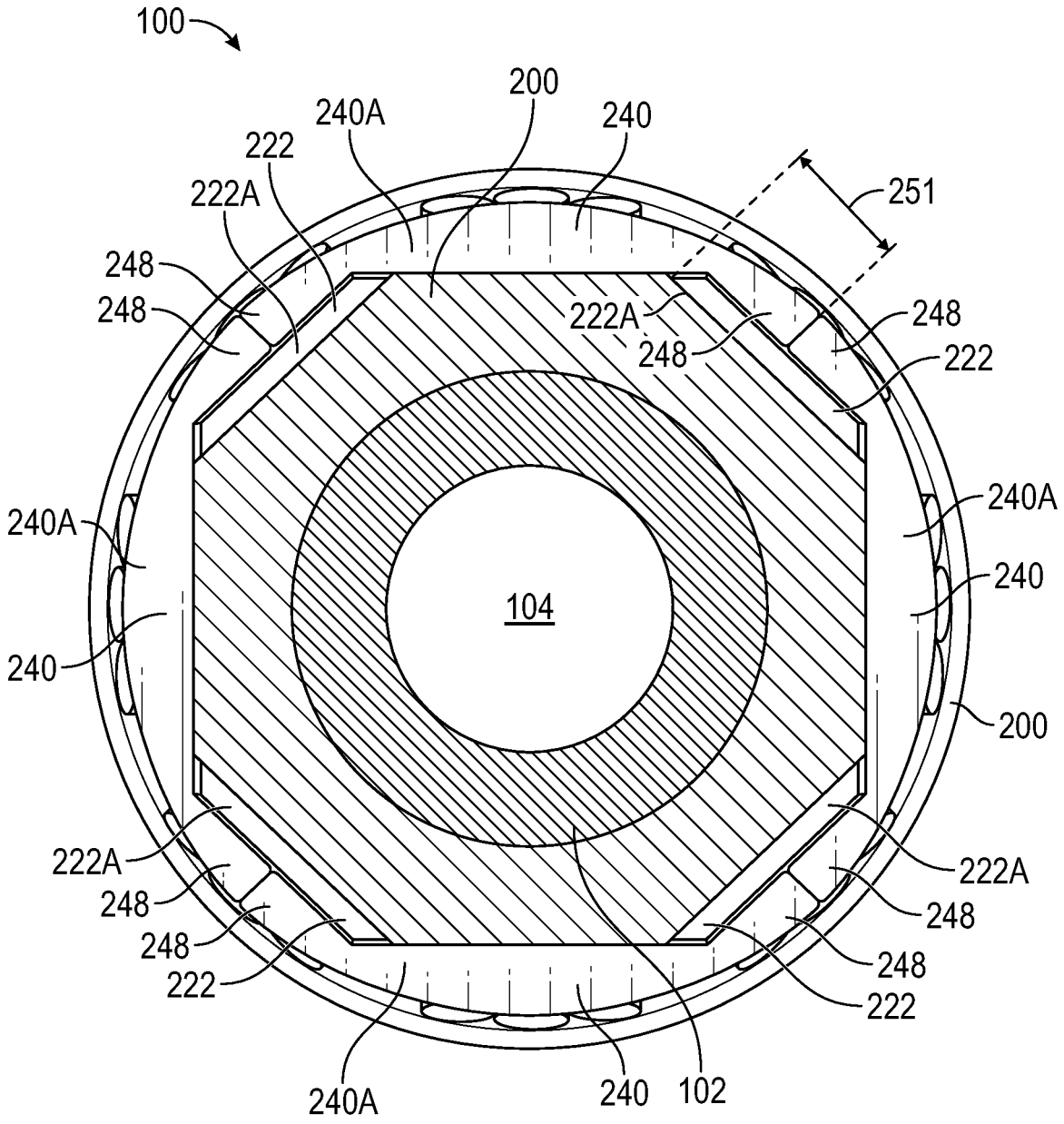
FIG. 11 is a cross-sectional view along line 11-11 of FIG. 10 of the downhole plug of FIG. 2.

As shown particularly in FIGS. 10, 11, when downhole plug 100 is in the run-in configuration, the terminal end 252 of each anti-extrusion member 248 is positioned directly adjacent or contacts the terminal end 252 of an anti-extrusion member 248 of an adjacently positioned second slip segment 240. Particularly, a second overlap 251 (shown in FIG. 11) extends arcuately between each anti-extrusion member 248 and each first slip segment 222. In this arrangement, the first end 222A of each first slip segment 222 is substantially or entirely engaged or covered by the engagement surfaces 254 of the anti-extrusion members 248 of adjacently positioned second slip segments 240. As downhole plug 100 actuates from the run-in configuration into the set configuration and slip segments 222, 240 are displaced radially outwards into the radially outer position and towards the inner surface 14 of casing string 12, the engagement surfaces 254 of anti-extrusion members 248 slide against the first ends 222A of first slip segments 222.

Figure 12:
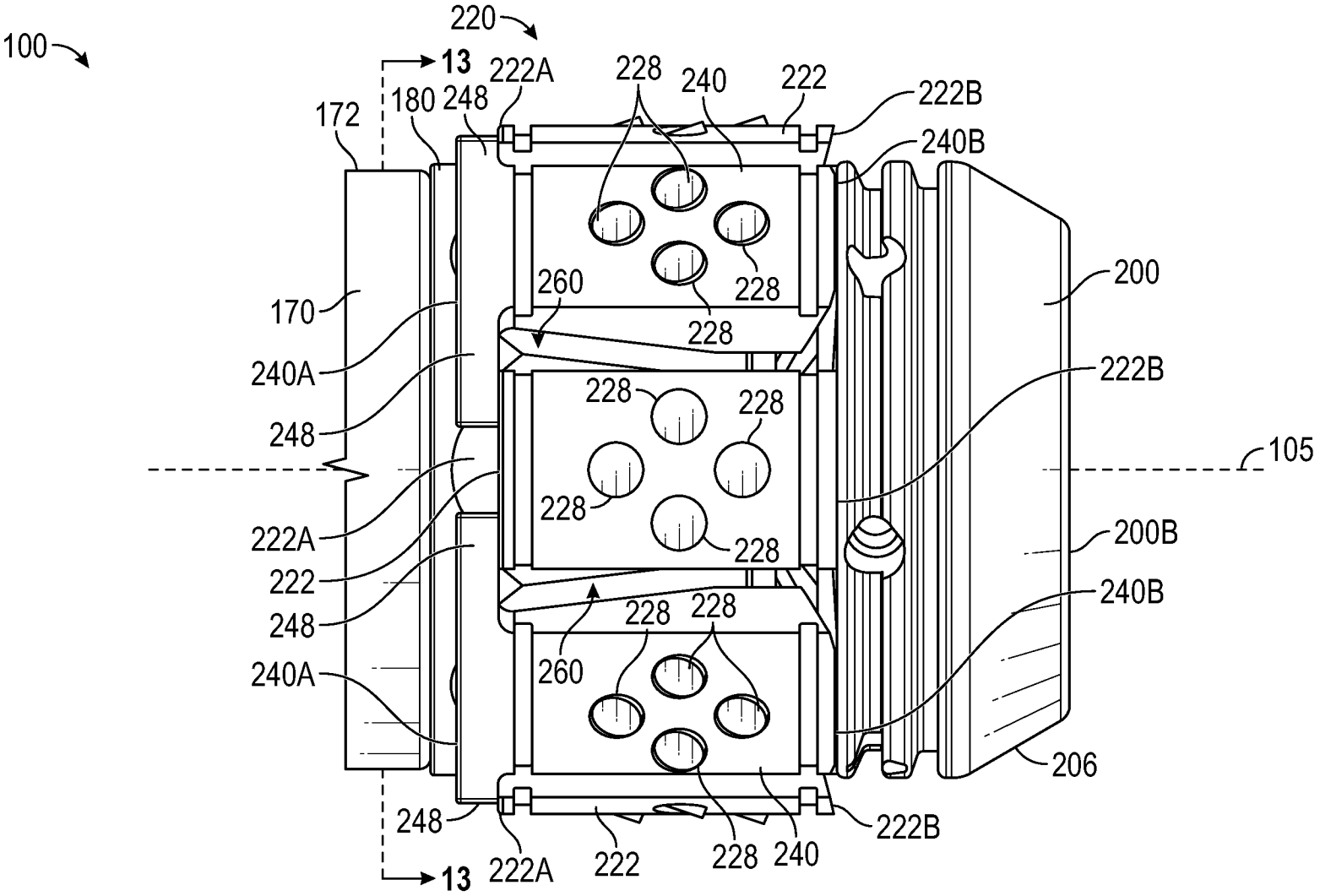
FIG. 12 is a partial side view of the downhole plug of FIG. 3 in a set configuration.
Figure 13:
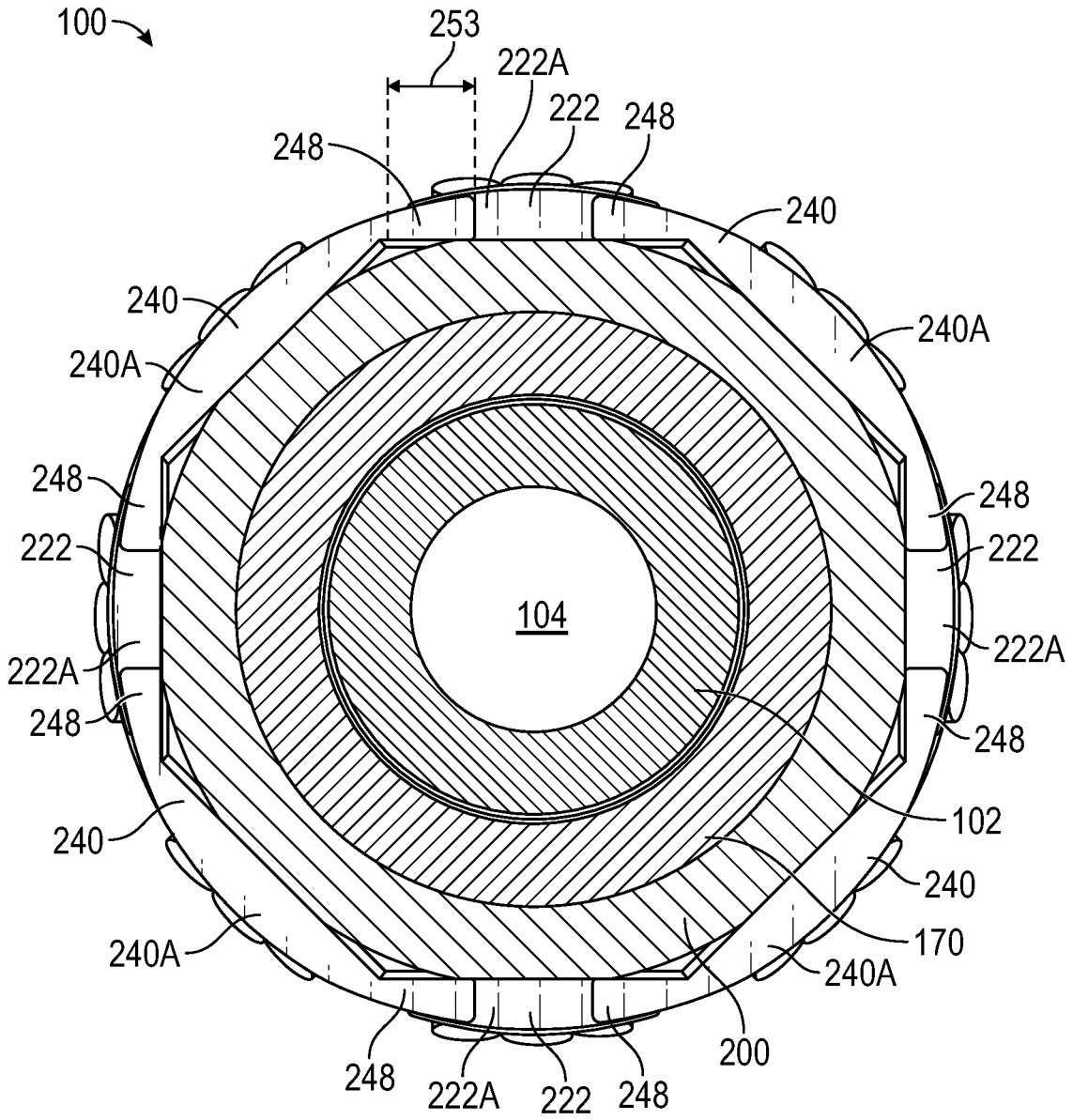
FIG. 13 is a cross-sectional view along line 13-13 of FIG. 12 of the downhole plug of FIG. 3.
Figure 14:
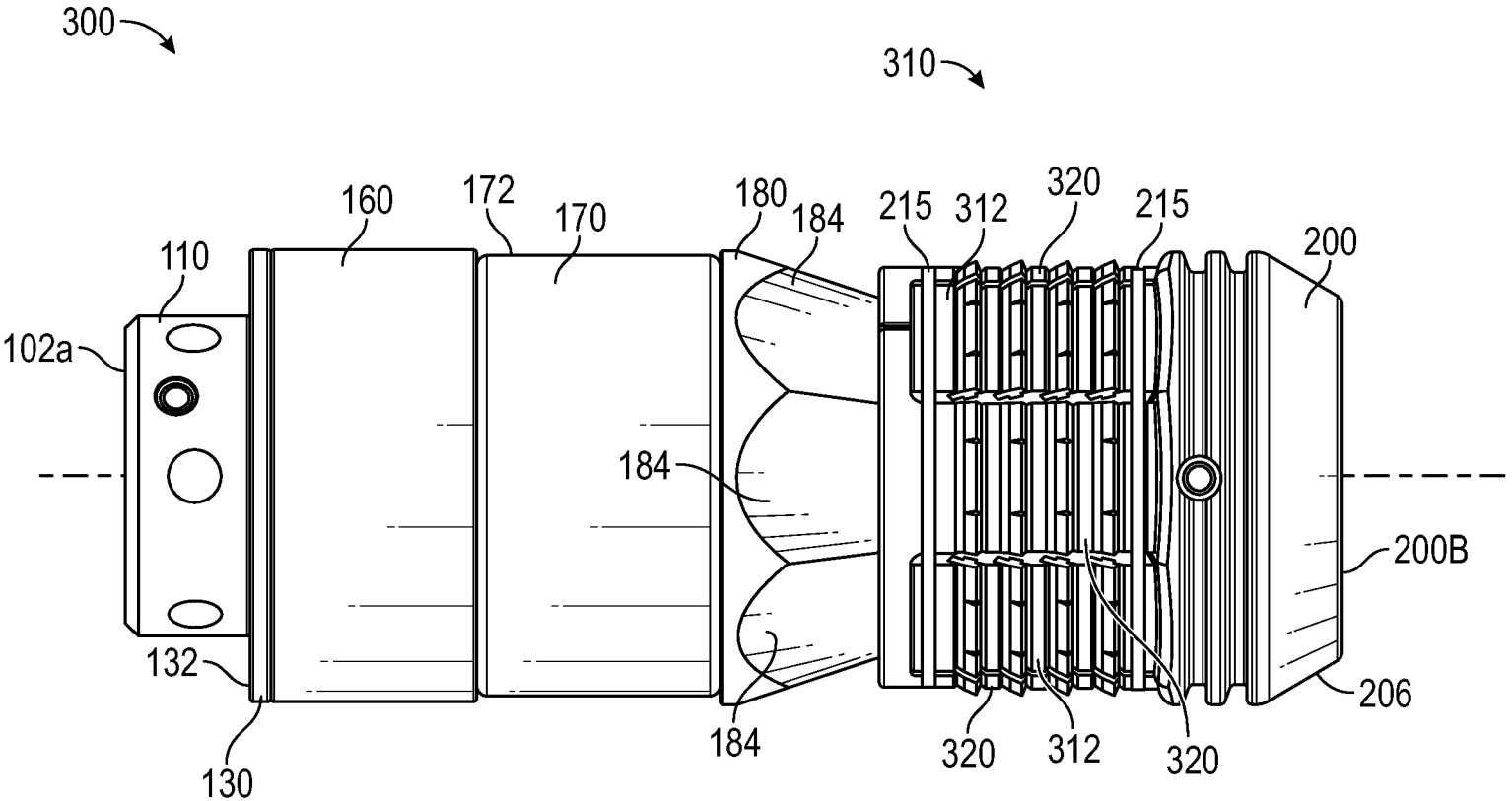
FIG. 14 is a side view of another embodiment of a downhole plug in accordance with principles disclosed herein.

With downhole plug 100 disposed in the set configuration as shown in FIGS. 12, 13, at least a portion of each anti-extrusion member 248 arcuately overlaps at least a portion of the first end 222A of an adjacently positioned first slip segment 222. Particularly, a second overlap 253 (shown in FIG. 13) extends arcuately between each anti-extrusion member 248 and each first slip segment 222 when slip segments 222, 240 are in the radially outer position. In this configuration, material of packer 170 is prevented from entering arcuate gaps 260 (shown in FIG. 12) that form radially between adjacently positioned slip segments 222, 240 as downhole plug 100 actuates into the set configuration and slip segments 222, 240 expand radially outwards. Thus, a circumferential spacing between each slip segment 222, 240 increases when slip segments 222, 240 are actuated form the radially inner position to the radially outer position. Additionally, with slip segments 222, 240 in the radially outer position directly adjacent the inner surface 14 of casing string 12, material of packer 170 is prevented from being extruded radially between slip segments 222, 240 and casing string 12. In other words, the flow of material of packer 170 is blocked by the first ends 222A, 240A of slip segments 222, 240, respectively, thereby maintaining the integrity of the annular seal formed between packer 170 and casing string 12.

Further, in addition to preventing or mitigating axial extrusion of packer 170 and loss of seal integrity between packer 170 and casing string 12, anti-extrusion members 248 of second slip segments 240 eliminate the need for an additional back-up ring separate from slip segments 222, 240 and nose cone 200, thereby minimizing the number of components comprising slip assembly 220, the overall cost associated with manufacturing downhole plug 100, and the total time required for assembling downhole plug 100. Additionally, by simplifying the assembly of downhole plug 100 by eliminating the need for a separate back-up ring, anti-extrusion members 248 reduce the likelihood of mis-assembly of downhole plug 100 that may prevent downhole plug 100 from operating as intended.

Following the coupling of slip segments 202 with casing string 12 and the sealing of packer 170 against casing string 12 (shown in FIG. 14), setting tool 50 may be disconnected from downhole plug 100, allowing setting tool 50 and the other components of tool string 20 to be retrieved to the surface of wellbore 4, with downhole plug 100 remaining at the desired location in wellbore 4. Once setting tool 50 is released from downhole plug 100, contact between frusto-conical surface 162 of first clamping member 160 and the frustoconical surfaces 146 of lock ring segments 142 applies an axial and radially inwards force against each lock ring segment 142. However, engagement between ratchet teeth 144 of lock ring segments 142 and ratchet teeth 120 of mandrel 102 prevent lock ring segments 142 from moving axially uphole relative to mandrel 102. With lock ring segments 142 prevented from travelling uphole in the direction of the upper end 102A of mandrel 102, downhole plug 100 is held in the set configuration. After tool string 20 has been retrieved from the wellbore 4, a ball or dart may be pumped into and through wellbore 4 until the ball lands against seat 108 of mandrel 102. With the ball seated on seat 108 of mandrel 102, fluid flow through passage 104 of mandrel 102 is restricted which, in conjunction with the seal formed by packer 170 against the inner surface 14 of casing string 12, seals the portion of wellbore 4 extending downhole from downhole plug 100 from the surface. Thus, additional fluid pumped into wellbore 4 from the surface is then directed through the perforations previously formed in casing string 12 by one or more of the perforating guns 30, thereby hydraulically fracturing the formation 6 at the desired location in wellbore 4.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A downhole plug for plugging a tubular member, the downhole plug comprising:

a packer configured to plug the tubular member in response to the plug being actuated from a first configuration to a second configuration; and a slip assembly having a central axis and configured to couple to the tubular member in response to the plug being actuated from the first configuration to the second configuration, the slip assembly comprising:

a plurality of slip segments circumferentially spaced around the central axis, each slip segment comprising a body where each body comprises:

a first end;

a second end longitudinally opposite the first end;

an outward face with at least one engagement member for coupling to the tubular member; and sides each facing an adjacent slip segment of the plurality of slip segments;

wherein the plurality of slip segments comprises a first set of slip segments and a second set of slip segments wherein each of the first set of slip segments is positioned directly between a pair of the second set of slip segments;

wherein a maximum longitudinal length of the body of each of the first set of slip segments is less than a maximum longitudinal length of the body of each of the second set of slip segments;

wherein each of the second set of slip segments include a pair of arcuately extending anti-extrusion members monolithically formed with the bodies of the second set of slip segments;

wherein the slip assembly has a radially inner configuration, and a radially outer configuration in which two anti-extrusion members arcuately overly each of the first set of slip segments.

2. The downhole plug of claim 1, further comprising a mandrel configured to couple to a setting tool for actuating the plug from the first configuration to the second configuration, wherein the packer and the slip assembly are each positioned about the mandrel.

3. The downhole plug of claim 1, wherein the anti-extrusion members of each of the first set of slip segments extend laterally from the first end of the body of the slip segment.

4. The downhole plug of claim 1, wherein:

the body of each of the first set of slip segments has a first width extending between the pair of lateral of sides of the body; and wherein a second width extending between a terminal end of a first anti-extrusion member of the pair of anti-extrusion members and a terminal end of a second anti-extrusion member of the pair of anti-extrusion members of each of the second set of slip segments is greater than the first width.

5. The downhole plug of claim 1, wherein a terminal end of one of the anti-extrusion members of the second set of slip segments contacts a terminal end of another of the anti-extrusion members of the second set of slip segments when the plug is in the first configuration.

6. The downhole plug of claim 1, wherein one of the pair of the anti-extrusion member of one of the second set of slip segments extends entirely across an arcuate gap formed between the one of the second set of segments and one of the first set of slip segments when the plug is in the second configuration.

7. The downhole plug of claim 1, wherein one of the anti-extrusion members of each of the second set of slip segments arcuately overlaps one of the first set of slip segments when the slip assembly is in the radially inner configuration.

8. The downhole plug of claim 1, wherein one of the anti-extrusion members of one of the second set of slip segments extends entirely across a gap formed between the one of the second set of slip segments and one of the first set of slip segments when the plug is in the second configuration.

9. The downhole plug of claim 1, wherein the first ends of each of both the first slip segments and the second slip segments are axially aligned with one another at a first axial position, the second ends of the second slip segments are axially aligned with one another at a second axial position, and the second ends of the first slip segments are axially aligned with one another at a third axial position located axially between the first axial position and the second axial position.

10. The downhole plug of claim 1, wherein the anti-extrusion members have a width oriented with the central axis of the slip assembly that is equal to an axial distance extending between the second axial position and the third axial position where an engagement surface is arranged to circumferentially extend from the second end of the second slip segment and a support surface is opposite the engagement surface across the width of the anti-extrusion member and contact and overlie the second end of the first slip segment.

11. The downhole plug of claim 1, wherein the pair of anti-extrusion members comprise a pair of arms positioned at the first end of the body and extending arcuately in opposing directions.

12. The downhole plug of claim 11, wherein each of the pair of arms of each second slip segment comprises a shoulder which slidingly engages the first end of the body of one of the first set of slip segments.

13. A downhole plug for plugging a tubular member, comprising:

a packer configured to plug the tubular member in response to the plug being actuated from a first configuration to a second configuration; and a slip assembly having a central axis and configured to couple to the tubular member in response to the plug being actuated from the first configuration to the second configuration, the slip assembly comprising:

a plurality of slip segments circumferentially spaced around the central axis, each slip segment comprising a body where each body comprises:

a first end;

a second end longitudinally opposite the first end:

an outward face with at least one engagement member for coupling to the tubular member; and sides each facing an adjacent slip segment of the plurality of slip segments;

wherein the plurality of slip segments comprises a first set of slip segments and a second set of slip segments wherein each of the first set of slip segments is positioned directly between a pair of the second set of slip segments;

wherein a maximum longitudinal length of the body of each of the first set of slip segments is less than a maximum longitudinal length of the body of each of the second set of slip segments, and wherein the first ends of each of both the first slip segments and the second slip segments are axially aligned with one another at a first axial position the second ends of the second slip segments are axially aligned with one another at a second axial position, and the second ends of the first slip segments are axially aligned with one another at a third axial position located axially between the first axial position and the second axial position;

wherein each of the second set of slip segments includes a pair of arcuately extending anti-extrusion members monolithically formed with the bodies of the second set of slip segments, and wherein the anti-extrusion members have a width oriented with the central axis of the slip assembly that is equal to an axial distance extending between the second axial position and the third axial position where an engagement surface is arranged to circumferentially extend from the second end of the second slip segment and a support surface is opposite the engagement surface across the width of the anti-extrusion member and contact and overlie the second end of the first slip segment;

wherein the slip assembly has a radially inner configuration, and a radially outer configuration in which two anti-extrusion members arcuately overlay each of the first set of slip segments.

14. The downhole plug of claim 13, further comprising a mandrel configured to couple to a setting tool for actuating the plug from the first configuration to the second configuration, wherein the packer and the slip assembly are each positioned about the mandrel.

15. The downhole plug of claim 13, wherein the pair of anti-extrusion members comprise a pair of arms positioned at the first end of the body and extending arcuately in opposing directions.

16. The downhole plug of claim 15, wherein each of the pair of arms of each second slip segment comprises a shoulder which slidingly engages the first end of the body of one of the first set of slip segments.

* * * * *